US005193815A

United States Patent [19]

Pollard

[11] Patent Number: 5,193,815

[45] Date of Patent: Mar. 16, 1993

[54] INSTANT BINGO GAME AND GAME CARD THEREFOR

[75] Inventor: Gordon Pollard, Manitoba, Canada

[73] Assignee: Pollard Banknote Limited, Winnipeg, Canada

[21] Appl. No.: 872,002

[22] Filed: Apr. 22, 1992

[51] Int. Cl.[5] ..... A63F 3/06

[52] U.S. Cl. ..... 273/269; 273/139; 273/DIG. 14; 283/901

[58] Field of Search ..... 273/139, 138 R, 269, 273/240, DIG. 14; 283/901, 903

[56] References Cited

U.S. PATENT DOCUMENTS 4,212,468 7/1980 Knott ..... 273/269

5,074,566 12/1991 Desbiens ..... 273/269

*Primary Examiner*—Benjamin H. Layno

*Attorney, Agent, or Firm*—Adrian D. Battison; Stanely G. Ade; Murray E. Thrift

[57] ABSTRACT

A bingo card for playing at an instant bingo game comprises a first area in which bingo numbers are printed and covered by an opaque layer which can be scratched away to individually reveal each bingo number in turn. The card further includes four separate bingo playing areas each of which is in the form of a bingo card with the numbers printed thereon in conventional manner. On top of each of the second playing areas is applied a translucent coat of a scratchable material which is pigmented so as to modify the appearance of the underlying color of the area. The playing area can therefore be marked in relation to those numbers appearing on the first area simply by scratching away the translucent layer to provide a visual distinction. The game card is simple and effective and requires printing of the playing numbers only once as they can be viewed through the translucent layer.

5 Claims, 2 Drawing Sheets

INSTANT BINGO GAME AND GAME CARD THEREFOR

This invention relates to a game card and particularly, but not exclusively, to an bingo game of a type which enables a single player to purchase and use a single bingo card to play a game of bingo simply using the printed numbers on the card.

A bingo game of this type is known in which a single bingo card includes a first area on which there are printed a plurality of bingo numbers selected from the group of numbers 1 through 75. The numbers are then covered by an opaque layer of a type which can be scratched away to reveal those numbers. The numbers can be then used in the playing of a bingo game and the card itself carries a second area on which the bingo game is to be played.

The second area includes a matrix of the type generally used as a bingo card having five columns in the matrix and a number of rows, usually five. The word "BINGO" is then associated with the columns so that each letter of the word is associated with the respective one of the columns.

In the columns are then printed numbers with the numbers in each column being selected from a subgroup of the total numbers. Thus in conventional bingo manner, the column associated with the letter "B" includes only those numbers from 1 through 15, the column associated with the letter "I" includes only the numbers 16 through 30, etc.

The game is then played by scratching the first area to reveal a first one of the numbers thereon and then by marking on the second area that number if it appears on the second area.

In the prior art device, the marking of the second area is provided by a scratchoff system in which an upper opaque layer covering the second area is scratched away. The numbers printed on the second area printed both on the top of the opaque layer so as to be visible before scratching and also underneath the opaque layer so as to be revealed again when the opaque layer is scratched away. The color of the opaque layer is arranged to be visually distinct from the underlying surface of the substrate on which the material is printed so that those numbers which have been scratched, that is the ones that have appeared in the first area, are visually distinct from those that have not been scratched.

This arrangement is however difficult and expensive to manufacture since it involves larger numbers of colored layers and since it involves the printing of the numbers in the second area twice firstly onto the basic substrate and then subsequently onto the opaque layer. This involves extra processes and involves significant difficulty in printing onto the opaque layer.

It is one object of the present invention, therefore, to provide an improved bingo game of this general type.

According to the invention, therefore, there is provided an instant bingo game comprising a substrate having defined thereon a first area and at least one second area separate from the first area, the first area having a plurality of bingo numbers printed thereon, the printed numbers being selected from the group consisting of the numbers between 1 and a predetermined maximum number with those numbers selected being used only once, the printed numbers being covered by a first layer of a material which is opaque to prevent viewing of the numbers through the layer and is removable by scratching to expose each printed number under an area of the layer removed by scratching, the second area having printed onto a surface of the substrate a matrix of rows and columns including five columns, the word BINGO arranged such that each letter is associated with a respective one of the columns, a plurality of numbers from said group, the numbers being arranged in said matrix and divided into five consecutive subgroups such that each column includes only numbers from a respective one of the subgroups and each column includes enough numbers from the subgroup just to fill the rows, the printed matrix including the printed numbers being covered by a second layer of a material which is translucent to allow viewing of the matrix including the printed numbers therethrough, is removable by scratching to expose the surface of the substrate, and is colored such that those portions of the surface of the substrate at the second area when viewed after removal of the second layer are visually distinct from those portions of the surface of the substrate at the second area when viewed through the second layer.

According to a second aspect of the invention there is provided a game card comprising a game card comprising a substrate, a colored layer over the substrate, a plurality of symbols printed onto the colored layer, and a coating applied over the printed symbols and over the colored layer, the coating being translucent to allow viewing of the printed symbols and the colored layer therethrough, the coating being removable by scratching to expose the colored layer and the symbols, and the coating being colored such that those portions of the colored layer when viewed after removal of the coating are visually distinct from those portions of the colored layer when viewed through the coating.

One embodiment of the invention will now be described in conjunction with the accompanying drawings in which

DETAIL DESCRIPTION

Figure 1:
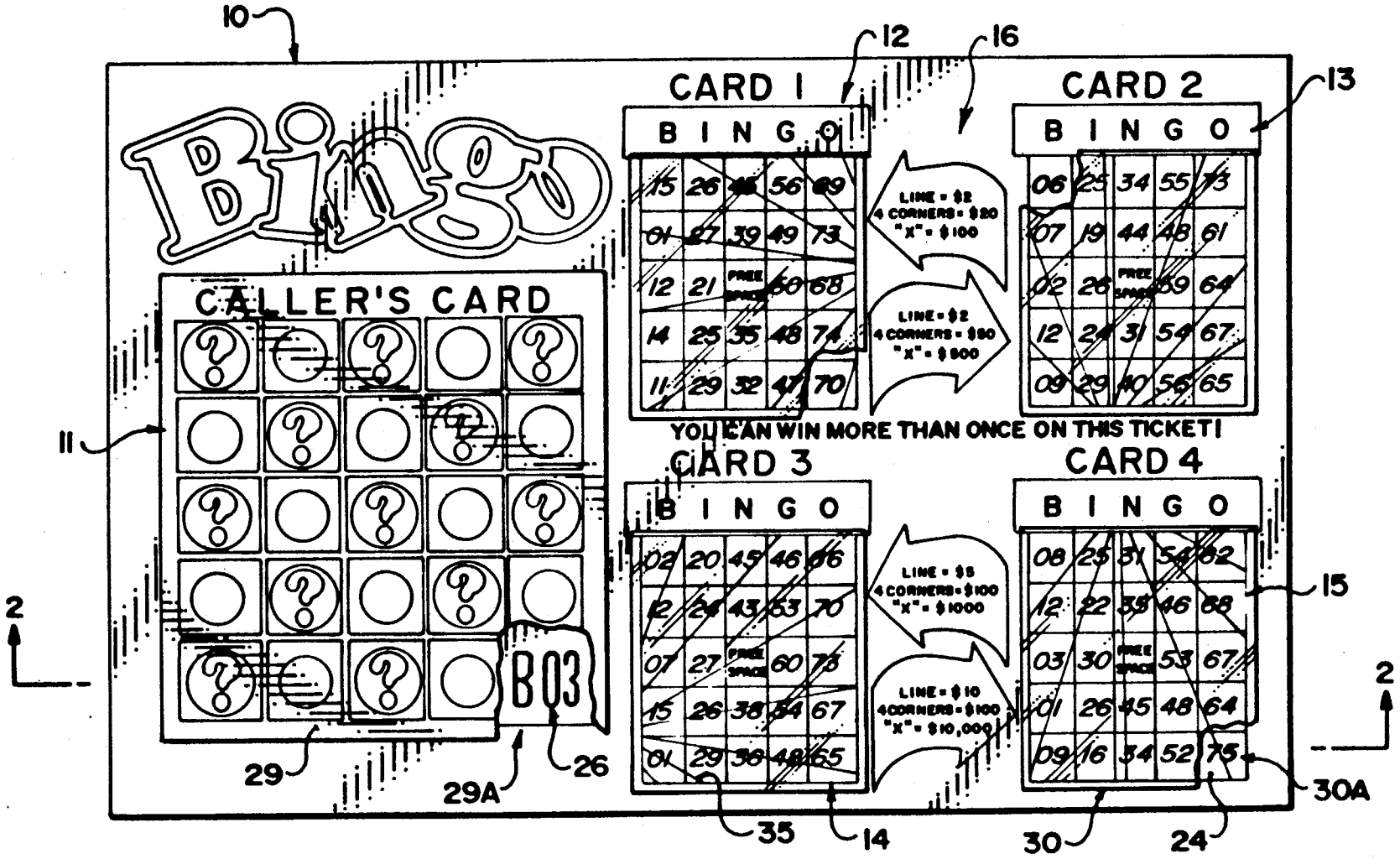
FIG. 1 is a plan view of a bingo game card according to the present invention.

The game card comprises a simple flat substrate 10 of a suitable card material on which printing can be received, generally of paper. Onto the substrate is printed a first area generally indicated at 11 and four second area generally indicated at 12, 13, 14 and 15. The first area includes the expression "caller's card" to identify the area on which the numbers to be played are located. The card further includes the word "BINGO" to identify the game involved.

Each of the second areas include the word "BINGO" together with a matrix of rows and columns. There are five such columns each associated with one of the letters of the word "BINGO" in the manner of a conventional bingo card.

In the matrix of each of the second areas, a plurality of numbers are printed in a conventional manner the numbers in the first column are selected from the numbers 1 through 15 and are aligned with the letter "B". The numbers in the second column are taken from the group 16 through 30 and are aligned with the letter "I". The remaining numbers up to 75 are associated in subgroups with the letters of the word and this is a well known bingo arrangment so that each number can be associated on the calling card with the letter to assist the player in locating the number on the second area.

The card further includes information generally indicated at 16 which provides information on the prizes to be won should be the numbers identified from the first area provide a certain pattern as identified on the information 16.

On top of the substrate 10 is provided a first layer of ink indicated at 20 which provides a number of different colors identifying the different areas. Thus there is a first color 21 which is used in the surrounding areas of the card. The first area 11 is printed in a different color indicated at 22. Each of the second areas 12 through 15 is again printed in a different color as indicated at 23 and 24. Thus the card includes a background of basic and a main area of one color and five further colors which are used to identify the first area on the four separate second areas.

On top of the basic printed layer defined by the substrate 10 and the layer of ink 20 are printed the required numbers as selected by a suitable statistical selection system. The system for selection does not form part of the present invention and accordingly will not be discussed in detail.

In the first area the numbers are indicated at 26. In the second area the numbers are indicated at 27. In the first area the numbers are associated with the relevant letter so that as shown in FIG. 1 one of the numbers "B-0-3" is visible so that "0-3" is associated with the B line. In the second areas the number is printed simply as a single number in the matrix described above.

On top of the numbers 26 and 27 is provided a layer of a gloss coat material 28 which is sufficiently hard to prevent damage to the ink layers underlying the gloss layer by scratching with a fingernail or a similar implement.

On top of the gloss layer is provided in the first area a coating 29. On top of the gloss layer in the second area is provided a coating 30. Each of these coatings 29 and 30 is of the type which can be readily scratched away by the fingernail of the player or other suitable implement operated by the player. The material is generally a latex which breaks into particles or collapses from the layer when scratched so that a portion of the layer can be removed while leaving the remainder of the layer in tact.

The layer 29 is however different from the layer 30 in that the layer 29 is fully opaque and thus prevents any viewing of the numbers underneath the layer 29 except when the layer 29 is removed. A portion of the layer 29 is shown 29A in FIG. 1 so that the underlying number 26 is visible whereas the remainder of the numbers are obscured or rendered invisible by the covering layer 29. As shown in FIG. 1, the layer 29 includes a number of colors layed out in a pattern to provide an attractive appearance which will enhance the pleasure of the player. The layer 29 includes a grid pattern or matrix formed as part of the layer 29 which is, shown in the area 29A, torn away with the layer 29 when scratched. The matrix approximates to the areas in which the underlying numbers 26 will be located. The underlying printed layer 22 under the numbers 26 is however plain and does not include the matrix or grid pattern.

The layer 30 is however translucent so that the numbers 27 is visible through the layer. The numbers 27 are printed in black over a lighter colored substrate ink layer 23 so that the numbers are sufficiently bold to be visible through the translucent layer. The translucent layer does however have sufficient coloring or pigmentation so that when viewed it appears differently from the underlying ink layer 24. Thus the layer 30 is translucent rather than transparent and does include pigmentation sufficient merely to alter the coloring of the underlying layer without obscuring the black or bold material printed thereon.

The opaque latex coating is readily available commerically. The translucent latex coating was not available prior to the present invention. However technologies are available in the art to manufacture such a coating which has sufficient pigment to provide the change of color required, which is sufficiently translucent to view the underlying numbers and is sufficiently robust to withstand normal handling.

The translucent layer has a pigment which is different from that of each of the four separate second areas, which are themselves all different. Thus for example the four areas can be yellow, green, pink and purple and the overlying translucent layer of blue. This ensures a strong "Hi-Lite" effect when the layer is moved while allowing printing of a single color of the overlying layer.

Figure 2:
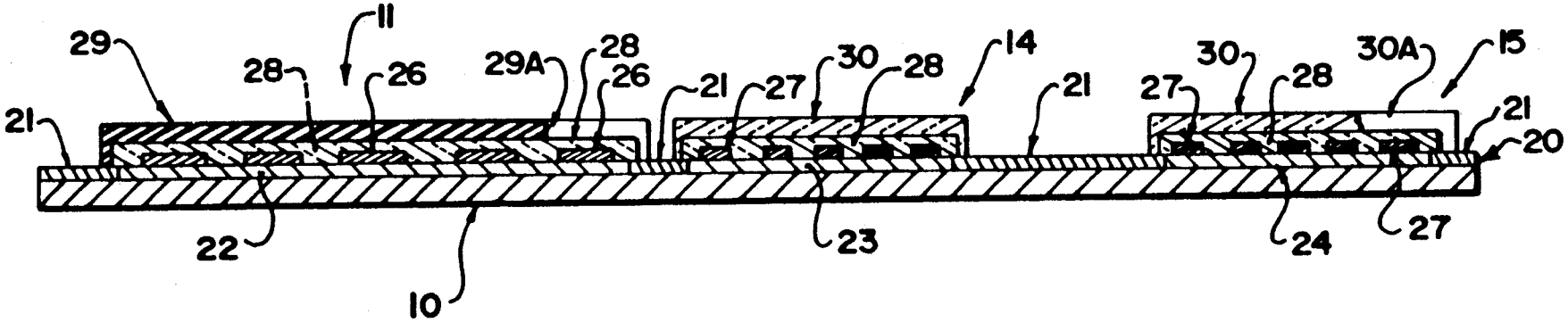
FIG. 2 is a cross sectional view along the lines 2—2 of FIG. 1 showing the various layers in schematic view with the thickness significantly exaggerated for clarity.

As shown in FIGS. 1 and 2 a part of the layer 30 is removed as indicated at 30A and it will be apparent that the layer 30 provides a pigmentation which alters the appearance of the underlying ink layer 24 so that when removed there is a clear visual distinction between the parts where the layer 30 have been removed and the parts where the layer has not been removed and therefore remains in place obscuring the layer 24.

Each of the second areas includes a plurality of printed lines thereon indicated at 35 which are arranged in an array transverse to the lines of the matrix or grid pattern and these lines 35 are used for security purposes to prevent or inhibit tampering with the cards to replace losing cards with numbers from other cards to create a winning card.

As both the numbers and the grid pattern itself on the second areas are printed only underneath the covering layer 30, it is necessary therefore to print these materials only once and to print them onto ink layers in a manner which is conventionally well known and readily achievable from a technical point of view. Subsequently the coating with the hard gloss transparent coat 28 is again conventionally available and technically well known. Finally the coating with the translucent coating 30 can be achieved without significant difficulty and without the technical difficulty of subsequently printing onto that coating of the material.

The game card is therefore simple to manufacture, less expensive and avoids any possibility of mix up due to the printing of different numbers on different layers of the device. The game however provides a very effective and simple way for a player to enjoy a bingo game using a single card and without necessity or inconvenience of using writing implements so thus the player simply needs the card and the fingernail to enjoy the gambling pleasures.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An instant bingo game comprising a substrate having defined thereon a first area and at least one second area separate from the first area, the first area having a plurality of bingo numbers printed thereon, the printed numbers being selected from the group consisting of the numbers between one and a predetermined maximum number with those numbers selected being used only once, the printed numbers being covered by a first layer of a material which is opaque to prevent viewing of the numbers through the layer and is removable by scratching to expose each printed number under an area of the layer removed by scratching, the second area having printed onto a surface of the substrate a matrix of rows and columns including five columns, the word BINGO arranged such that each letter is associated with a respective one of the columns, a plurality of numbers from said group, the numbers being arranged in said matrix and divided into five consecutive subgroups such that each column includes only numbers from a respective one of the subgroups and each column includes enough numbers from the subgroup just to fill the rows, the printed matrix including the printed numbers being covered by a second layer of a material which is translucent to allow viewing of the matrix including the printed numbers therethrough, is removable by scratching to expose the surface of the substrate, and is colored such that those portions of the surface of the substrate at the second area when viewed after removal of the second layer are visually distinct from those portions of the surface of the substrate at the second area when viewed through the second layer.

2. The game according to claim 1 including a plurality of second areas, each of the second area having a surface of the substrate which is of a different color from the other second areas and wherein the second layer covers each of the second areas and is of the same material and coloring on each of the second areas.

3. The game according to claim 1 wherein the second layer is applied to the substrate only on the second area.

4. A game card comprising a substrate, a colored layer over the substrate, a plurality of symbols printed onto the colored layer, and a coating applied over the printed symbols and over the colored layer, the coating being translucent to allow viewing of the printed symbols and the colored layer therethrough, the coating being removable by scratching to expose the colored layer and the symbols, and the coating being colored such that those portions of the colored layer when viewed after removal of the coating are visually distinct from those portions of the colored layer when viewed through the coating.

5. A game card according to claim 4, which there is provided a plurality of separate colored layers at spaced locations on the substrate each of which is a different color from the other layers and wherein the coating covers each of the layers and is of the same material and color on each of the layers.

* * * * *